US009639060B1

(12) United States Patent
Jan et al.

(10) Patent No.: US 9,639,060 B1
(45) Date of Patent: May 2, 2017

(54) DIVING WATCH ASSEMBLY

(71) Applicants: Hung-Yeh Jan, New Taipei (TW); Chien-Lung Chan, New Taipei (TW)

(72) Inventors: Hung-Yeh Jan, New Taipei (TW); Chien-Lung Chan, New Taipei (TW)

( * ) Notice: Subject to any disclaimer, the term of this patent is extended or adjusted under 35 U.S.C. 154(b) by 0 days.

(21) Appl. No.: 15/073,343

(22) Filed: Mar. 17, 2016

(51) Int. Cl.
*G04B 47/06* (2006.01)
*G04B 37/08* (2006.01)
*B63C 11/02* (2006.01)

(52) U.S. Cl.
CPC ..... *G04B 47/066* (2013.01); *B63C 11/02* (2013.01); *G04B 37/08* (2013.01); *B63C 2011/021* (2013.01)

(58) Field of Classification Search
CPC ..... G04B 37/08; G04B 47/066; B63C 11/02; B63C 2011/021
See application file for complete search history.

(56) References Cited

U.S. PATENT DOCUMENTS 4,197,747 A * 4/1980 Koehler ..... G04B 37/1406 224/245
4,352,168 A * 9/1982 Anderson ..... B63C 11/32 341/16
4,466,285 A * 8/1984 Allemano ..... B63C 11/32 368/281
4,520,668 A * 6/1985 Allemano ..... B63C 11/32 235/83
4,999,606 A * 3/1991 Comerford ..... B63C 11/02 128/201.19
5,097,826 A * 3/1992 Gray ..... B63C 11/32 128/202.22
5,251,190 A * 10/1993 Miyasaka ..... G04G 21/02 368/10
5,570,688 A * 11/1996 Cochran ..... A62B 9/006 128/201.27
6,054,929 A * 4/2000 Garofalo ..... B63C 11/02 128/205.22
6,278,659 B1 * 8/2001 Yokouchi ..... G04G 21/02 368/11
7,144,198 B2 * 12/2006 Hirose ..... B63C 11/02 405/186
2008/0066748 A1 * 3/2008 Felske ..... A62B 9/006 128/202.22

* cited by examiner

*Primary Examiner* — Vit W Miska
(74) *Attorney, Agent, or Firm* — Muncy, Geissler, Olds & Lowe, P.C.

(57) ABSTRACT

A diving watch assembly includes an internal airtight and waterproof space formed by a housing, an upper cover, a transparent plate and a lower cover, and an air pressure watch core, a water pressure watch core and a dial disc installed in the internal airtight and waterproof space. The air pressure watch core is adapted to drive a first pointer, and the water pressure watch core is adapted to drive the second pointer. The air pressure (air amount) scale and the water pressure (water amount) scale are respectively indicated by the first pointer and the second pointer on the same dial disc.

6 Claims, 7 Drawing Sheets

DIVING WATCH ASSEMBLY

BACKGROUND OF THE INVENTION a) Field of the Invention

The invention relates in general to a diving watch assembly for diving, and more particular to an improved diving watch designed with an airtight and waterproof housing and including an air pressure watch core and a water pressure watch core. Further, in the diving watch of the invention, an air pressure scale and a water pressure scale are displayed on one single dial disc to facilitate a diver to inspect a diving depth and air residual of a gas cylinder.

b) Description of the Prior Art

A diving watch assembly is an essential equipment for diving. A conventional diving watch assembly mainly includes a water pressure gauge and an air pressure gauge. The water pressure gauge senses the water pressure to display a depth of the diver. The air pressure gauge is connected to a gas cylinder via an air pressure tube, and senses the air pressure of the gas cylinder to display air residual in the gas cylinder.

In an assembly of the above conventional diving watch assembly, one single water pressure gauge and one single air pressure gauge are generally embedded on a watch sheath formed by a rubber or plastic. Such type of diving watch assembly further includes a third type of watch surface on the watch sheath, e.g., a compass or even a lighting lamp, to provided the diving watch assembly with more thorough functions. However, in the above conventional diving watch assembly, as the water pressure gauge and the air pressure gauge occupy spaces of two the watch surface, the watch sheath is required to not only use a larger amount of material but also have a sufficient surface area for accommodating the two watch surfaces of the water pressure gauge and the air pressure gauge. Thus, the watch sheath has a larger overall volume and a heavier weight, causing utilization, portability and collection inconveniences.

Another drawback of the above conventional diving watch assembly is that, each type of diving information (e.g., air residual and diving depth) is provided by one display watch surface, meaning that a diver needs visually switch between two water surfaces at different positions, hence increasing the possibility of misjudgment.

SUMMARY OF THE INVENTION

To overcome the above issues, the present invention provides a diving watch assembly having a smaller volume and a lighter weight for enhancing portability and collection conveniences.

The primary object of the present invention is to provide a diving watch assembly. In the diving watch assembly, an air pressure watch core and a water pressure watch core are assembled in a same airtight and waterproof housing, and an air pressure scale and a water pressure scale are displayed on one single dial disc to facilitate a diver to inspect a diving depth and cylinder air residual.

To achieve the above object, the present invention adopts following technical means.

A diving watch assembly of the present invention includes an internal airtight and waterproof space formed by a housing, an upper cover, a transparent plate and a lower cover, and an air pressure watch core, a water pressure watch core and a dial disc installed in the internal airtight and waterproof space.

The housing, substantially a cylindrical hollow structure, includes an upper opening shaped as a trumpet opening at an upper end of the housing, an upper fastening groove at an outer periphery of the upper opening, a lower opening at a lower end of the housing, a lower fastening groove at an outer periphery of the lower opening, an inner flange at an inner periphery surface of the housing, and an air pressure tube opening at a side surface of the housing. The hollow internal space of the housing is adapted to accommodate the air pressure watch core, the water pressure watch core and the dial disc.

The upper cover is a hollow annular structure, and includes a protruding fastener at an inner periphery of the upper cover. The protruding fastener may fasten in the upper fastening groove of the housing to allow the upper cover and the housing to be closely fastened to each other.

The transparent plate is assembled between the upper cover and the housing. An annular sealing packing is provided between a bottom portion of the transparent plate and the upper opening of the housing to provide a sealing and anti-leaking function between the upper cover and housing.

The lower cover includes a protruding fastener at an inner periphery of the lower cover. The protruding fastener may fasten in the lower fastening groove of the housing to allow the lower cover and the housing to be closely fastened to each other. A plurality of water pressure holes are provided at a surface of the lower cover. A water pressure film is provided between the lower cover and the lower opening of the housing. The water pressure film and the water pressure holes allow the water pressure watch core to sense the water pressure. The water pressure film at the same time provides a sealing and anti-leaking function between the lower cover and the housing.

The air pressure watch core includes a first pointer (air pressure pointer) at an end of an axle of the air pressure watch core, and is installed in an upper space of the housing. An air inlet of the air pressure watch core may be exactly placed in the air pressure tube opening of the housing. The air pressure watch core is connected to a gas cylinder through an externally connected air pressure connector and an air pressure tube to sense the air residual in the gas cylinder. The air residual may be indicated by the first pointer on the dial disc.

The water pressure watch core includes a second pointer (water pressure pointer) at an end of an axle of the water pressure watch core, and is installed in a lower space of the housing. An internal sensing assembly of the water pressure watch core may be driven by the water pressure film to sense the water pressure of the diving depth. The water pressure may be indicated by the second pointer on the dial disc.

The dial disc is substantially a planar structure, and includes a central planar portion and an outer ramp portion. An axle opening is provided at an central end of the planar portion. An air pressure (air amount) scale is provided at a surface of the planar portion. A circular cut channel is provided between the planar portion and the ramp portion, and planar portion and the ramp portion are connected by a part that is not cut by the cut channel in between. A water pressure (water depth) scale is provided at a surface of the ramp portion.

The ramp portion of the dial disc exactly corresponds to the trumpet opening-shaped upper opening of the housing, such that the dial disc may be exactly accommodated in the upper opening of the housing. The axle opening on the dial disc may be penetrated by the axle of the air pressure watch core. The axle drives the first pointer to indicate the air residual in the gas cylinder. The circular cut channel on the dial disc may be penetrated by the second pointer of the water pressure watch core. The second pointer indicates the water pressure scale, i.e., the diving depth.

The diving watch assembly formed by the above components offers obvious advantages below. The air pressure watch core and the water pressure watch core are assembled inside the same housing, such that the components of the diving watch assembly are simplified and reduced in number while also significantly reducing the volume of the diving watch assembly. Therefore, the diving watch assembly of the present invention may be embedded at a water sheath having a smaller surface area to provide the watch sheath with a lighter overall weight, thereby not only reducing production costs of the diving watch assembly and the watch sheath but also enhancing portability and collection conveniences in actual applications.

Further, in the diving watch assembly of the present invention, with one single dial disc provided, the air residual in the gas cylinder is displayed at the central planar portion of the dial disc, and the diving depth is displayed at the outer ramp portion of the dial disc. Thus, a diver may easily read required diving information from one single watch surface, hence effectively improving drawbacks of a conventional diving watch assembly.

The above and other aspects of the invention will become better understood with regard to the following detailed description of the preferred but non-limiting embodiments. The following description is made with reference to the accompanying drawings.

DETAILED DESCRIPTION OF THE PREFERRED EMBODIMENTS

Figure 1:
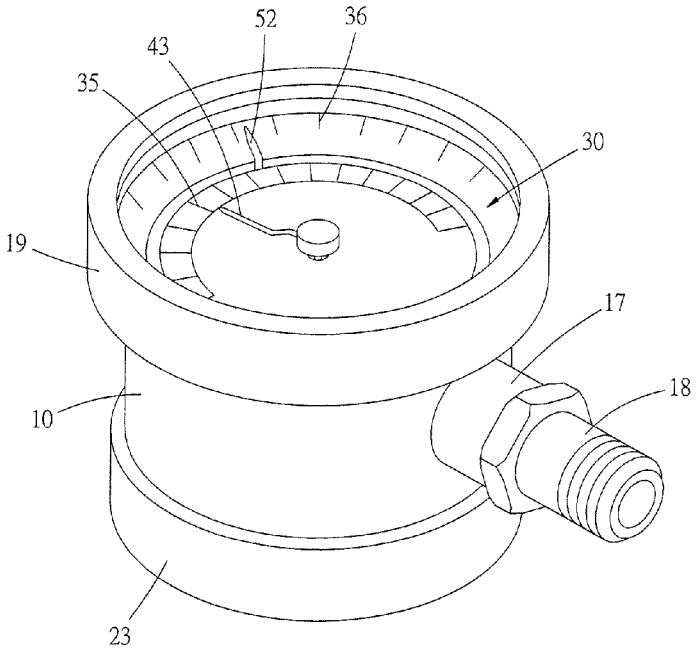
FIG. 1 is a perspective view of a diving watch assembly according to a preferred embodiment of the present invention.
Figure 5:
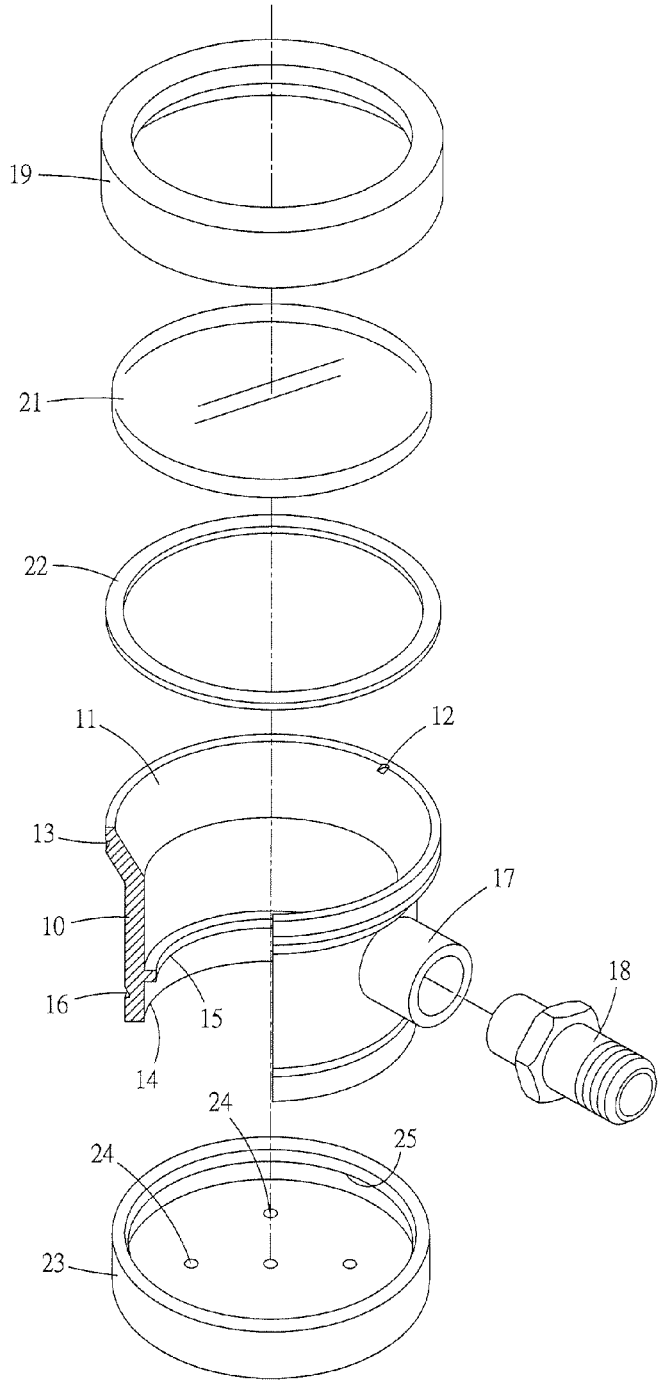
FIG. 5 is a section view of a housing, an upper cover, a transparent plate and a lower cover of a diving watch assembly of the present invention, with the housing being partially sectioned in the diagram.
Figure 6:
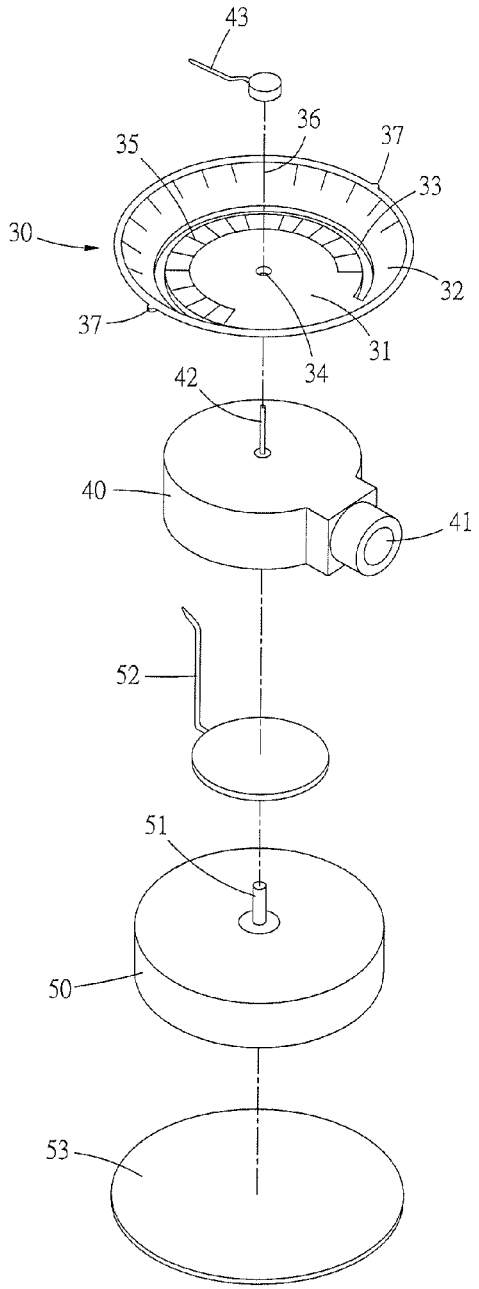
FIG. 6 is an exploded view of an air pressure watch core, a water pressure watch core and a dial disc of a diving watch assembly of the present invention.

Referring to FIG. 5 and FIG. 6, a diving watch assembly of the present invention includes an airtight and waterproof internal space formed by a housing 10, an upper cover 19, a transparent plate 21 and a lower cover 23, and an air pressure watch core 40, a water pressure watch core 50 and a dial disc 30 installed in the internal space. A complete assembly of the diving watch assembly of the present invention is as shown in FIG. 1.

Figure 4:
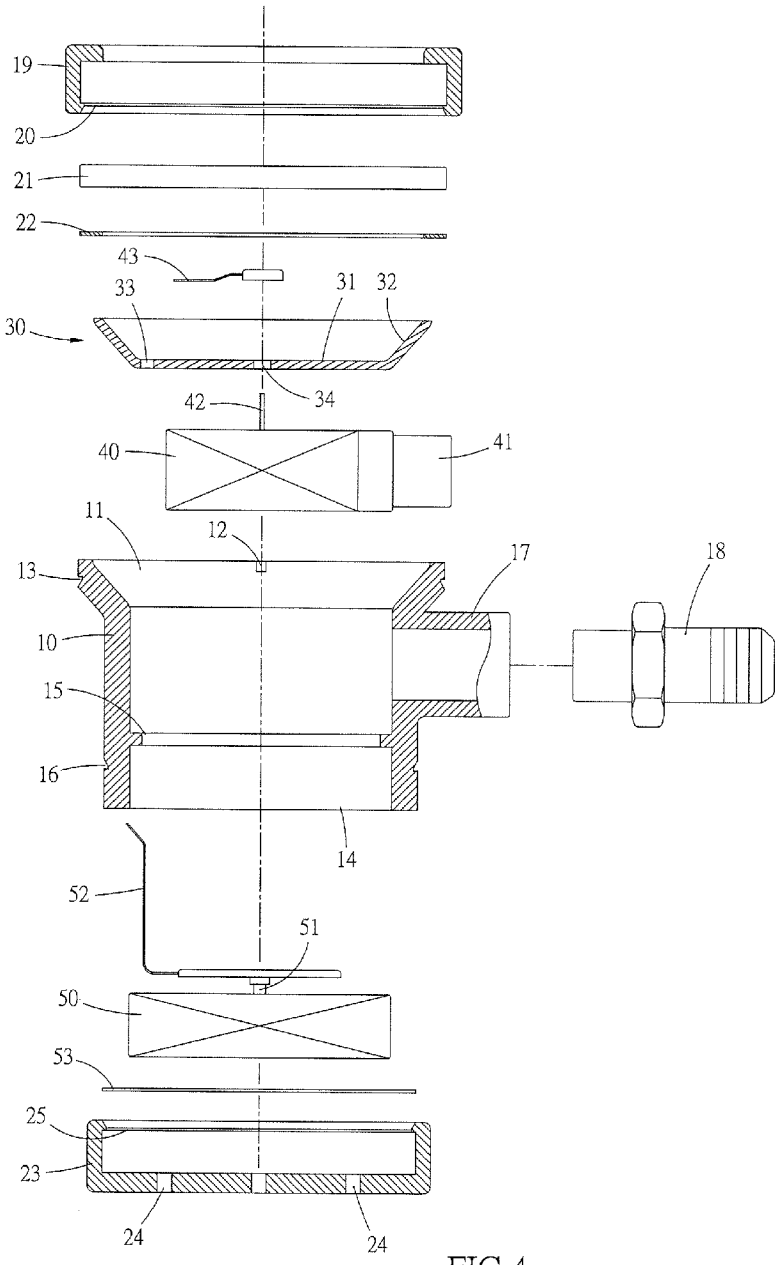
FIG. 4 is an exploded view of components of the diving watch assembly in FIG. 3.

Referring to FIG. 4 and FIG. 5, the housing 10 is substantially a hollow cylindrical structure. The housing 10 includes an upper opening 11 shaped as a trumpet opening at an upper end of the housing 10, an annular upper fastening groove 13 at an outer periphery of the upper opening 11, a lower opening 14 at a lower end of the housing 10, a lower fastening groove 16 at an outer periphery of the lower opening 14, an annular inner flange 15 at an inner periphery surface of the housing 10, and an air pressure tube opening 17 at a side surface of the housing 10. The hollow internal space of the housing 10 may accommodate the air pressure watch core 40, the water pressure watch core 50 and the dial disc 30.

As shown in FIG. 4 and FIG. 5, the upper cover 19 is a hollow annular structure, and includes a protruding fastener 20 at an inner periphery of the upper cover 19. The protruding fastener 20 may be fastened in the upper fastening groove 13 of the housing 10 to allow the upper cover 19 and the housing 10 to be closely fastened to each other.

The transparent plate 21 is assembled between the upper cover 19 and the housing 10. An annular sealing packing 22 is provided between a lower portion of the transparent plate 21 and the upper opening 11 of the housing 10 to provide a sealing and anti-leakage function between the upper cover 19 and the housing 10.

As shown in FIG. 4 and FIG. 5, the lower cover 23 includes a protruding fastener 25 at an inner periphery of the lower cover 23. The protruding fastener 25 may be fastened in the lower fastening groove 16 of the housing 10 to allow the lower cover 23 and the housing 10 to be closely fastened to each other. A plurality of water pressure holes 24 are provided at a surface of the lower cover 23. A water pressure film 53 is provided between the lower cover 23 and the lower opening 14 of the housing 10. The water pressure film 53 and the water pressure holes 24 allow the water pressure watch core 50 to sense the water pressure. The water pressure film 53 at the same time provides a sealing and anti-leaking function between the lower cover 23 and the housing 10.

Figure 3:
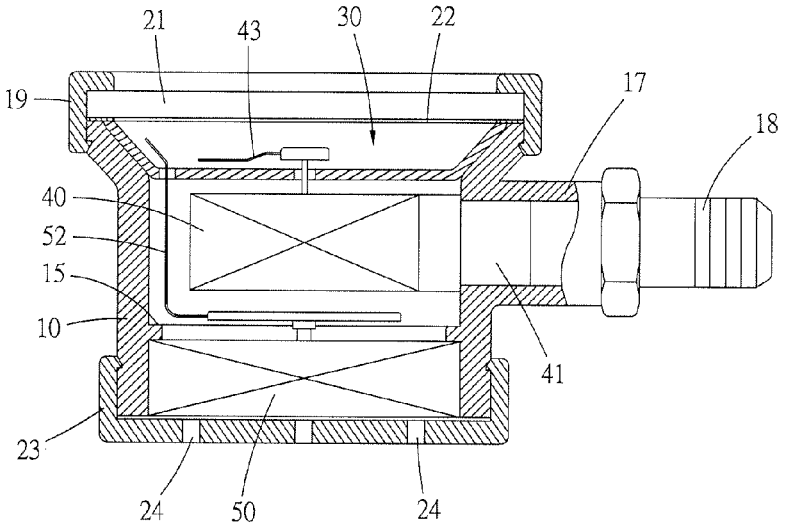
FIG. 3 is a section view of assembled components of the diving watch assembly in FIG. 2.

As shown in FIG. 4 and FIG. 6, the air pressure watch core 40 includes an air inlet 41 at a side of the air pressure watch core 40, and a first pointer 43 installed on an axle 42 of the air pressure watch core 40, as shown in FIG. 3. The air pressure watch core 40 is installed in an upper space of the housing 10, and the air inlet 41 of the air pressure watch core 40 may be exactly placed into the air pressure tube opening 17 of the housing 10, as shown in FIG. 3. The air pressure watch core 40 is connected to a gas cylinder (not shown) through an externally connected air pressure connector 18 and an air pressure tube (not shown), and is for sensing air residual in the gas cylinder. The air residual may be then indicated on the dial disc 30 by the first pointer 43.

As shown in FIG. 4 and FIG. 6, the water pressure watch core 50 includes a second pointer 52 installed on an axle 51 of the water pressure watch core 50. The second pointer 52 is an upwardly curved pointer shape, and extends upwards along a gap between the air pressure watch core 40 and the housing 10, as shown in FIG. 3. Further, a tip of the second pointer 52 penetrates a cut channel 33 on the dial disc 30 and extends to above the dial disc 30.

As shown in FIG. 4 and FIG. 6, the water pressure watch core 50 is installed in the housing 10, and is located in a lower space between the inner flange 15 and the lower opening 14. The water pressure watch core 50 has an upper end surface in contact with the inner flange 15, and a lower end surface covered by the water pressure film 53. A sensing assembly in the water pressure watch core 50 may be exactly pushed by the water pressure film 53, such that the water pressure drives the second pointer 52 through the axle 51 of the water pressure watch core 50 and is displayed by the second pointer 52 on the dial disc 30.

Figure 7:
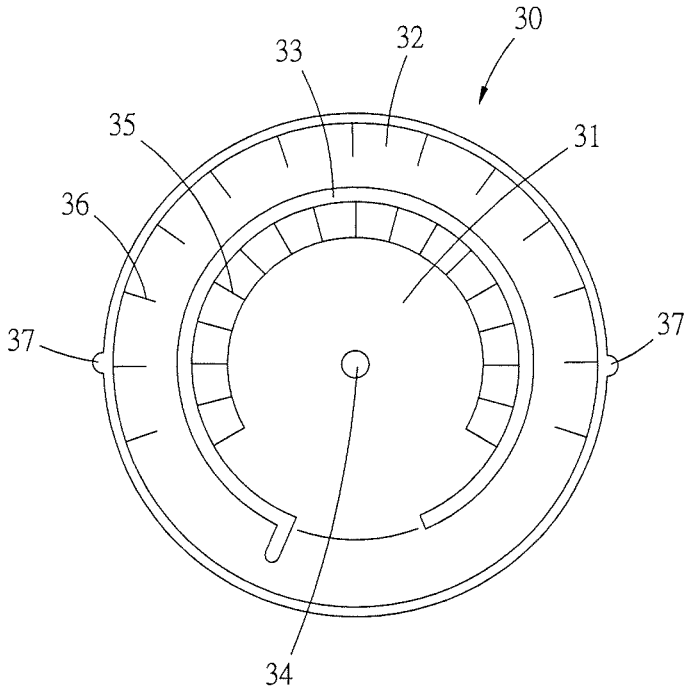
FIG. 7 is a top view of a dial disc of a diving watch assembly of the present invention.

As shown in FIG. 6 and FIG. 7, the dial disc 30 is substantially a plate-like structure, and includes a central planar portion 31 and an outer annular ramp portion 32. At the dial disc 30, an axle opening 34 is provided at the central end of the planar portion 31, and an air pressure (air amount) scale 35 is provided at a surface of the planar portion 31. The circular cut channel 33 is provided between the planar portion 31 and the ramp portion 32, and the planar portion 31 and the ramp portion 32 are connected by a part that is not cut by the cut channel 33 in between. A water pressure (water depth) scale 36 is provided at a surface of the ramp portion 32.

As shown in FIG. 4, FIG. 5 and FIG. 6, the ramp portion 32 of the dial disc 30 exactly corresponds to the trumpet opening-shaped upper opening 11 of the housing 10, such that the dial disc 30 may be exactly accommodated in the upper opening 11 of the housing 10, as shown in FIG. 3. The axle opening 34 at the center of the dial disc 30 may be penetrated by the axle 42 of the air pressure watch core 40. The axle 42 drives the first pointer 43, which then indicates the air residual in the gas cylinder on the air pressure (air amount) scale 35 of the planar portion 31. The circular cut channel 33 on the dial disc 30 may be penetrated by the second pointer 52 of the water pressure watch core 50. The second pointer 52 indicates the diving depth on the water pressure (water depth) scale 36 of the ramp portion 32.

Referring to FIG. 5, at least one positioning notch 12 is provided at the inner periphery of the upper opening 11 of the housing 10. A tenon 37 is provided at a position corresponding to each of the positioning notches 12 of the housing 10 at an outer periphery of the dial disc 30, as shown in FIG. 6 and FIG. 7. When the dial disc 30 is accommodated in the upper opening 11 of the housing 10, the dial disc 30 may be securely positioned through the tenon 37 and the positioning notch 12.

Figure 2:
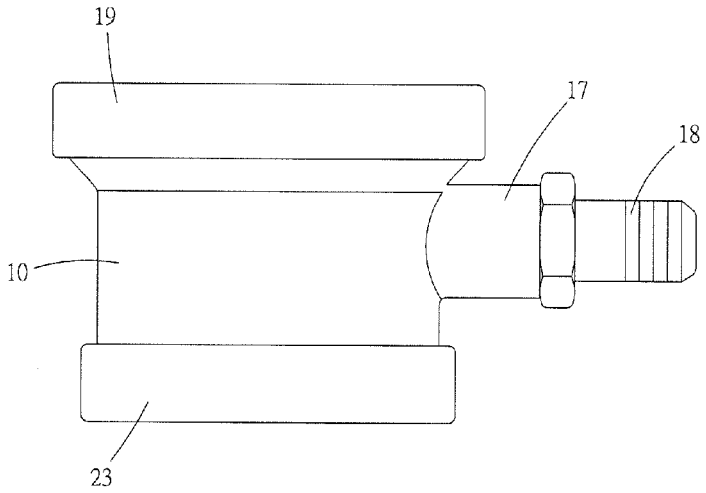
FIG. 2 is a side view of the diving watch assembly in FIG. 1.

When the diving watch assembly of the present invention based on the foregoing description is completely assembled, an appearance of the diving watch assembly is substantially as shown in FIG. 1 and FIG. 2. With the single housing 10 and the single dial disc 30, the air residual of the gas cylinder and the diving depth can both be displayed. Therefore, the diving watch assembly of the present invention may be independently applied without involving an additional external watch sheath.

It can be clearly observed from FIG. 3 that, in the diving watch assembly of the present invention, the air pressure watch core 40 and the water pressure watch core 50 installed inside the same housing 10 are assembled in a vertically overlapping assembly to reduce the overall volume. When necessary, the present invention may be embedded to a watch sheath having a smaller surface, so that more spaces and positions on the water sheath can be provided for installing other watch surfaces or tools, e.g., a compass or a lighting lamp. Further, the overall volume of the diving watch assembly of the present invention is smaller in volume and lighter in weight compared to a conventional diving watch assembly.

While the invention has been described by way of example and in terms of the preferred embodiments, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A diving watch assembly, comprising:

a housing, being a hollow cylindrical structure, including an upper opening shaped as a trumpet opening at an upper end of the housing, a lower opening at a lower end of the housing, an annular inner flange at an inner periphery surface of the housing, and an air pressure tube opening at a side surface of the housing;

an upper cover, being a hollow annular structure, adapted to fasten at the upper opening of the housing to allow the upper cover and the housing to be closely fastened to each other;

a transparent plate, assembled between the upper cover and the housing, including an annular sealing packing between a lower portion of the transparent plate and the upper opening of the housing;

a lower cover, adapted to fasten at the lower opening of the housing, a plurality of water pressure holes being provided at a surface of the lower cover, a water pressure film being provided between the lower cover and the lower opening of the housing to cause the lower cover and the housing to be closely fastened to each other;

an air pressure watch core, installed in an upper space of the housing, including a first pointer at an axle of the air pressure watch core and an air inlet at a side of the air pressure watch core, adapted to be exactly placed into the air pressure tube opening of the housing, connected to a gas cylinder through externally connected air pressure connector and an air pressure tube, for sensing a pressure of air residual in the gas cylinder;

a water pressure watch core, installed in a space between the inner flange and the lower opening of the housing, including a second pointer at an axle of the water pressure watch core, the water pressure watch core having an upper end surface in contact with the inner flange and a lower end surface covered by the water pressure film, a sensing assembly in the water pressure watch core adapted to be driven by the water pressure film and for sensing a diving depth; and a dial disc, being a plate-like structure, including a central planar portion, an outer ramp portion, an axle opening provided at a central end of the planar portion for penetrating the axle of the air pressure watch core, an air pressure (air amount) scale at a surface of the planar portion, a circular cut channel between the planar portion and the ramp portion for penetrating the second pointer of the water pressure watch core, and a water pressure (water depth) scale at a surface of the ramp portion;

wherein, the air pressure watch core is adapted to drive the first pointer according to the air pressure sensed, and the water pressure watch core is adapted to drive the second pointer according to the water pressure sensed, to indicate air residual in the gas cylinder and diving depth of a diver by the first pointer and the second pointer on the same dial disc, respectively.

2. The diving watch assembly according to claim 1, wherein the housing further includes an annular upper fastening groove at an outer periphery of the upper opening of the housing, a protruding fastener corresponding to the upper fastening groove is provided at an inner periphery of the upper cover, the housing further includes an annular lower fastening groove at an outer periphery of the lower opening, and a protruding fastener corresponding to the lower fastening groove is provided at an inner periphery of the lower cover.

3. The diving watch assembly according to claim 1, wherein the second pointer on the axle of the water pressure watch core is an upwardly curved pointer shape and extends upwards along a gap between the air pressure watch core and the housing, and has a tip thereof penetrates the cut channel on the dial disc and extend to above the ramp portion of the dial disc.

4. The diving watch assembly according to claim 1, wherein the ramp portion of the dial disc corresponds to the trumpet opening-shaped upper opening of the housing to accommodate the dial disc in the upper opening.

5. The diving watch assembly according to claim 1, wherein the housing further includes at least one positioning notch at an inner periphery of the upper opening of the housing, a tenon is provided at a position corresponding to the positioning notch at an outer periphery of the dial disc, the dial disc is accommodated in the upper opening of the housing, and the dial disc is securely positioned through the tenon and the positioning notch.

6. The diving watch assembly according to claim 4, wherein the housing further includes at least one positioning notch at an inner periphery of the upper opening of the housing, a tenon is provided at a position corresponding to the positioning notch at an outer periphery of the dial disc, the dial disc is accommodated in the upper opening of the housing, and the dial disc is securely positioned through the tenon and the positioning notch.

* * * * *